US005427633A

United States Patent [19]

Fujisawa et al.

[11] Patent Number: 5,427,633

[45] Date of Patent: Jun. 27, 1995

[54] SLIDE SURFACE CONSTRUCTION

[75] Inventors: Yoshikazu Fujisawa; Takahiro Gunji; Masamune Tabata; Kazuhisa Okamoto, all of Saitama, Japan

[73] Assignee: Honda Giken Kogyo Kabushiki Kaisha, Tokyo, Japan

[21] Appl. No.: 164,222

[22] Filed: Dec. 7, 1993

[30] Foreign Application Priority Data

Dec. 7, 1992 [JP] Japan ..... 4-351332

[51] Int. Cl.[6] ..... C22C 38/00; C22C 38/60

[52] U.S. Cl. ..... 148/320

[58] Field of Search ..... 148/320

[56] References Cited

U.S. PATENT DOCUMENTS 3,666,569 6/1969 Hultgren ..... 148/320

FOREIGN PATENT DOCUMENTS 640599 12/1963 Belgium ..... 148/320

861460 1/1971 Canada ..... 148/320

*Primary Examiner*—Deborah Yee

*Attorney, Agent, or Firm*—Lyon & Lyon

[57] ABSTRACT

A slide surface construction is formed of an aggregate of Fe crystals having a body-centered cubic structure. The aggregate includes at least one of two types of metal crystals selected from the group consisting of (1) (h00) oriented metal crystals with their (h00) planes (by Miller indices) oriented toward a slide surface and having a content S in a range represented by S<25%, and (2) (3hh0) oriented metal crystals with their (3hh0) planes (by Miller indices) oriented toward the slide surface and having a content S in a range represented by S<25%. If both the types of the oriented Fe crystals are present, a large number of trigonal pyramid-shaped Fe crystals are precipitated in the slide surface, thereby providing improved oil retention and initial conformability. Thus, the slide surface construction exhibits an excellent seizure resistance.

7 Claims, 15 Drawing Sheets

SLIDE SURFACE CONSTRUCTION

BACKGROUND OF THE INVENTION

1. Field of the Invention

The present invention relates to a slide surface construction constituting a slide surface for a mating member.

2. Description of the Prior Art

An example of such conventionally known slide surface construction is an Fe-plated layer which is formed around the outer peripheral surfaces of a land portion and a skirt portion of a base material of an aluminum alloy, for example, in a piston for an internal combustion engine, in order to improve the wear resistance of the piston.

However, under existing circumstances where a high speed and a high output of the internal combustion engine are desired, the prior art slide surface constructions suffer from problems of insufficient oil retaining property, i.e., oil retention, and poor initial conformability and seizure resistance.

SUMMARY OF THE INVENTION

It is an object of the present invention to provide a slide surface construction of the type described above, which has a sufficient oil retention and a good initial conformability by specifying the crystal structure, thereby providing an improved seizure resistance.

To achieve the above object, according to the present invention, there is provided a slide surface construction, which is formed of an aggregate of metal crystals having a body-centered cubic structure, the aggregate including at least one of two types of metal crystals: (h00) oriented metal crystals with their (h00) planes (by Miller indices) oriented toward a slide surface and having a content S in a range represented by $S<25\%$, and (3hh0) oriented metal crystals with their (3hh0) planes (by Miller indices) oriented toward the slide surface and having a content S in a range represented by $S<25\%$.

If the (h00) oriented metal crystals with their (h00) planes (by Miller indices) oriented toward the slide surface and/or the (3hh0) oriented metal crystals with their (3hh0) planes (by Miller indices) oriented toward the slide surface are present in the above-described concentrations in the aggregate of the metal crystals having the body-centered cubic structure, a large number of relatively large pyramid-shaped (and/or truncated pyramid-shaped) metal crystals are precipitated in the slide surface into mutually biting states. As a result, the slide surface takes on an intricate morphology comprising a large number of fine crests, a large number of fine valleys formed between the crests, and a large number of swamps formed due to the mutual biting of the crests. Therefore, the slide surface construction has an improved oil retention. In addition, the initial conformability of the slide surface construction is enhanced by the preferential wearing of tip ends of the pyramid-shaped metal crystals. Thus, the slide surface construction exhibits an excellent seizure resistance. However, if the content S of the (h00) oriented metal crystals is equal to or more than 25%, or if the content S of the (3hh0) oriented metal crystals is equal to or more than 25%, the morphology of the slide surface tends to be simplified with an increase in content of the oriented metal crystals and hence, the oil retention and initial conformability of the slide surface construction are reduced.

The above and other objects, features and advantages of the invention will become apparent from the following description of a preferred embodiment, taken in conjunction with the accompanying drawings.

DESCRIPTION OF THE PREFERRED EMBODIMENTS

Figure 1:
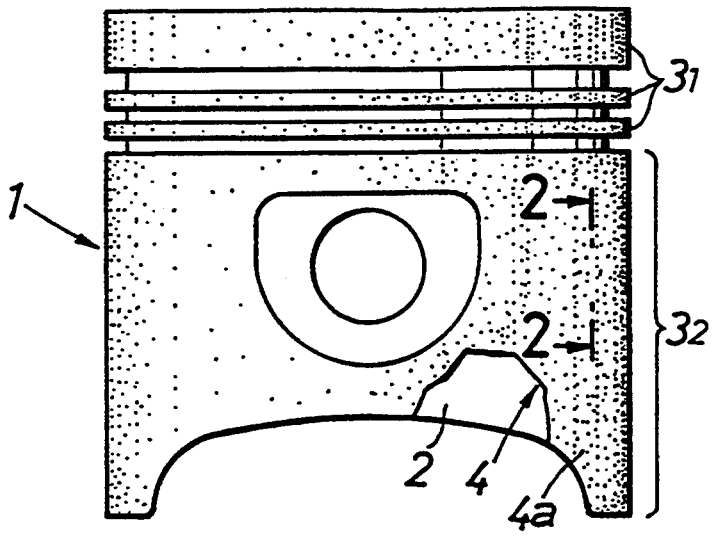
FIG. 1 is a side view of a piston.
Figure 2:
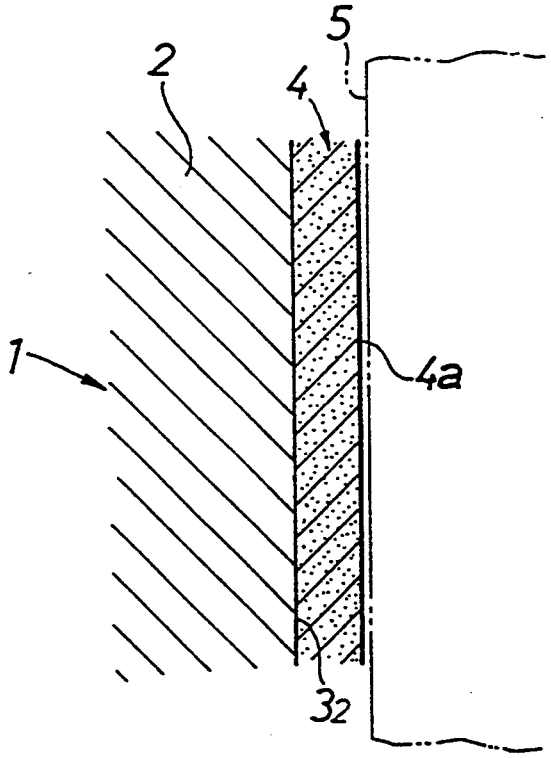
FIG. 2 is a sectional view taken along line 2—2 in FIG. 1.

Referring to FIGS. 1 and 2, a piston 1 for an internal combustion engine includes a base material 2 of an aluminum alloy. A lamellar slide surface construction 4 is formed by plating on outer peripheral surfaces of a land portion $3_1$ and a skirt portion $3_2$ of the base material 2.

Figure 3:
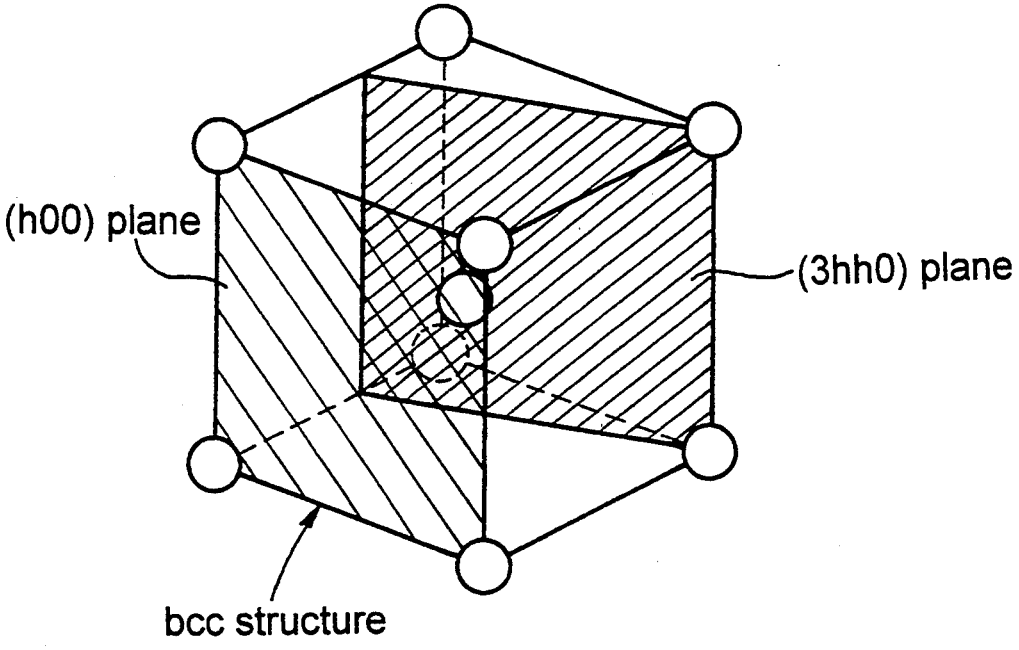
FIG. 3 is a perspective view illustrating a body-centered cubic structure and its (h00) and (3hh0) planes.
Figure 4:
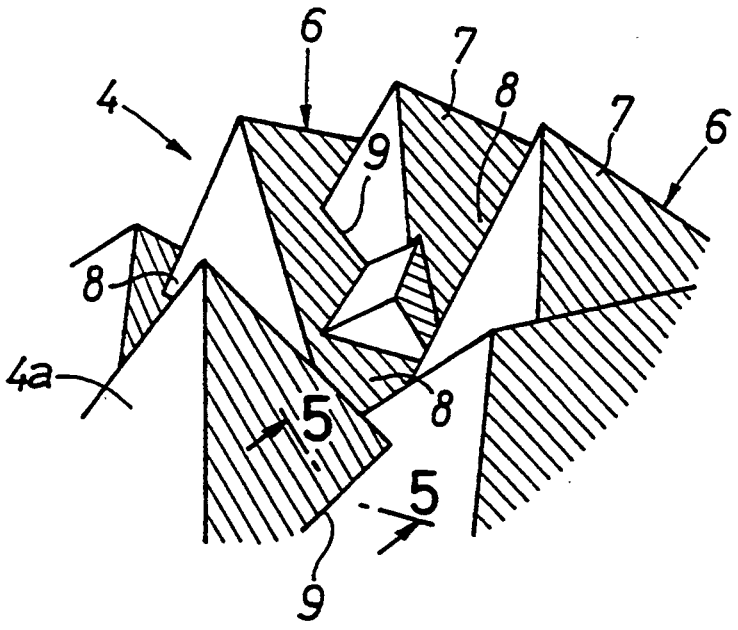
FIG. 4 is a perspective view of an essential portion of one example of a slide surface construction.
Figure 5:
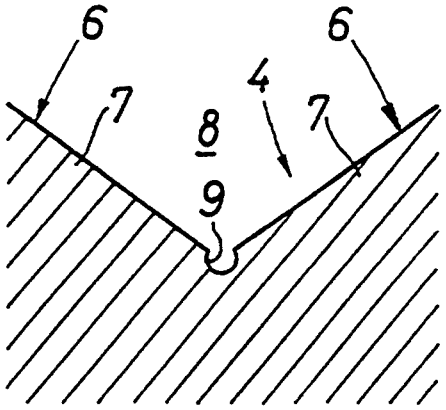
FIG. 5 is a sectional view taken along line 5—5 in FIG. 4.

As shown in FIGS. 3 and 4, the slide surface construction 4 is formed of an aggregate of metal crystals having a body-centered cubic structure (bcc structure). The aggregate includes (h00) oriented metal crystals with their (h00) planes oriented toward the slide surface **4*a* for an inner wall 5 of a cylinder bore and/or (3hh0) oriented metal crystals with their (3hh0) planes oriented toward the slide surface 4*a* for the inner wall 5**. The content S of the (hh0) oriented crystals and the (3hh0)

oriented crystals are set in a range represented by $S<25\%$, respectively.

For example, if both the oriented metal crystals are present at the levels in the above-described ranges, a large number of relatively large pyramid and/or truncated pyramid-shaped, e.g., trigonal pyramid-shaped (in the illustrated embodiment) metal crystals 6 are precipitated in the slide surface 4*a* into mutually biting states. Thus, the slide surface 4*a* takes on an intricate morphology comprising a large number of fine crests 7, a large number of fine valleys 8 between the crests 7, and a large number of fine swamps 9 formed due to the mutual biting of the crests 7. Therefore, the slide surface construction 4 has good oil retention. In addition, the tip ends of the trigonal pyramid-shaped metal crystals are preferentially worn, thereby providing an improved initial conformability to the slide surface construction 4.

Figure 6:
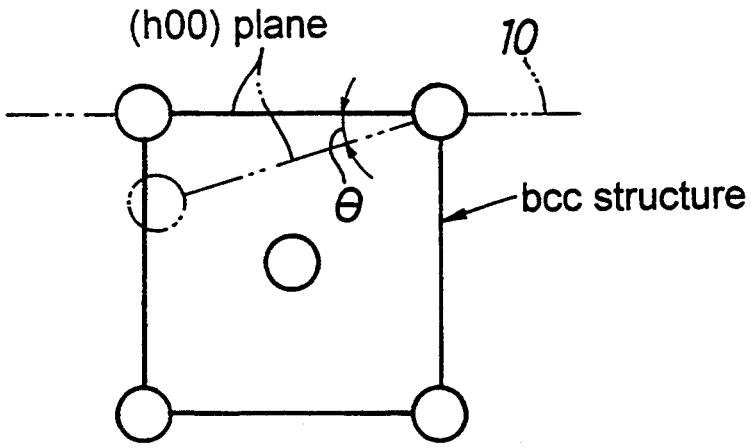
FIG. 6 is a diagram for explaining an inclination of the (h00) plane in the body-centered cubic structure.

As shown in FIG. 6, the inclination of the (h00) plane with respect to a phantom plane 10 along the slide surface 4*a* will cause an inclination of the trigonal pyramid-shaped metal crystal 6 and hence, an influence is imparted to the oil retention and initial conformability of the slide surface construction 4. Thereupon, the inclination angle formed by the (h00) plane with respect to the phantom plane 10 is set in a range represented, by $0° \leqq \theta \leqq 15°$. The inclination angle $\theta$ of the (3hh0) plane is likewise set in a range represented by $0° \leqq \theta \leqq 150°$. In this case, the direction of the inclination of the (h00) and (3hh0) planes is not limited. If the inclination angle of the (h00) and (3hh0) planes is larger than 15°, the oil retention and the initial conformability of the slide surface construction 4 are reduced.

Examples of the metal crystal having the bcc structure are those of simple metals such as Fe, Cr, Mo, W, Ta, Sr, Nb, V, etc., and the alloys thereof.

In the plating treatment for forming the slide surface construction 4 according to the present invention, basic conditions for the electrolytic deposition of the Fe-plating are shown in Tables 1 and 2.

TABLE 1

| Plating bath composition (g/liter) | | | |
|---|---|---|---|
| Ferrous sulfate | Boric acid | Ammonium sulfate | Organic additive(s) |
| 150~400 | 5~50 | 50~200 | 10~150 |

TABLE 2

| Treating conditions | | |
|---|---|---|
| Plating bath pH | Plating bath temperature (°C.) | Cathode current density (A/dm$^2$) |
| 2~6.5 | 10~60 | 0.1~3 |

In the electrolytic deposition of the Fe-plating under the above-described conditions, the precipitation and content of the (h00) and (3hh0) oriented Fe crystals are controlled by the cathode current density, the pH of the plating bath, the amount of organic additive incorporated and the like.

In addition to the electrolytic plating processes, examples of other plating treatments that may also be used include PVD processes, CVD processes, sputtering processes, ion plating and the like, which are gas-phase plating processes. Conditions for W- or Mo-plating by a sputtering process are, for example, an Ar pressure of 0.2 to 1 Pa, an Ar acceleration power of 0.1 to 1.5 kW in direct current; and a base material temperature of 80 to 300° C. Conditions for W-plating by a CVD process are, for example, a $WF_6$ starting material; a gas flow rate of 2 to 15 cc/min.; a pressure of 50 to 300 Pa within the chamber; and a base material temperature of 300 to 600° C.

Particular examples will be described below.

A plurality of pistons 1 for internal combustion engines were produced by subjecting the outer peripheral surfaces of a land portion $3_1$ and a skirt portion $3_2$ of a base material of an aluminum alloy to an electrolytic Fe-plating process to form a slide surface construction 4 comprised of an aggregate of Fe crystals.

Tables 3 to 6 show the conditions for the electrolytic Fe-plating process for examples 1 to 17 of the slide surface constructions 4, wherein Tables 3 and 5 show the plating bath composition, and Tables 4 and 6 show the treating conditions.

TABLE 3

| Example No. | Plating bath composition (g/liter) Ferrous sulfate | Boric Acid | Ammonium sulfate | Urea | Saccharin |
|---|---|---|---|---|---|
| 1 | 230 | 30 | 100 | 100 | 1 |
| 2 | 230 | 30 | 100 | 100 | 1 |
| 3 | 230 | 30 | 100 | 100 | 1 |
| 4 | 230 | 30 | 100 | 100 | 1 |
| 5 | 230 | 30 | 100 | 100 | 1 |
| 6 | 230 | 30 | 100 | 100 | 0.4 |
| 7 | 230 | 30 | 100 | 100 | 1 |
| 8 | 230 | 30 | 100 | 100 | 1 |
| 9 | 230 | 30 | 100 | 100 | 0.4 |

TABLE 4

| Example No. | Treating conditions Plating bath pH | Plating bath temperature (°C.) | Cathode current density (A/dm$^2$) |
|---|---|---|---|
| 1 | 6 | 50 | 0.2 |
| 2 | 6 | 50 | 1 |
| 3 | 6.2 | 50 | 0.2 |
| 4 | 5.1 | 50 | 1 |
| 5 | 5.8 | 50 | 1 |
| 6 | 4 | 50 | 1 |
| 7 | 2.8 | 50 | 1 |
| 8 | 6.2 | 50 | 1 |
| 9 | 4.2 | 50 | 5 |

TABLE 5

| Example No. | Plating bath composition (g/liter) Ferrous sulfate | Boric Acid | Ammonium sulfate | Urea | Saccharin |
|---|---|---|---|---|---|
| 10 | 230 | 30 | 100 | 100 | 0.4 |
| 11 | 230 | 30 | 100 | 100 | 0.4 |
| 12 | 230 | 30 | 100 | 100 | 0.4 |
| 13 | 300 | 30 | 100 | 20 | 0.4 |
| 14 | 300 | 30 | 100 | 20 | 1 |
| 15 | 300 | 30 | 100 | 20 | 1 |
| 16 | 300 | 30 | 100 | 20 | 0.4 |
| 17 | 230 | 30 | 100 | 100 | 0.4 |

TABLE 6

| Example No. | Treating conditions Plating bath pH | Plating bath temperature (°C.) | Cathode current density (A/dm$^2$) |
|---|---|---|---|
| 10 | 4 | 50 | 5 |
| 11 | 3.2 | 50 | 7 |
| 12 | 2.7 | 50 | 7 |
| 13 | 3.3 | 50 | 10 |
| 14 | 5.4 | 50 | 10 |
| 15 | 6.2 | 50 | 6 |
| 16 | 3.3 | 50 | 8 |
| 17 | 3.5 | 50 | 7 |

Tables 7 and 8 show the crystal shape of the slide surface 4a, the grain size of the Fe crystals, the content S of the oriented Fe crystals and the hardness for Examples 1 to 17.

TABLE 7

| Example No. | Crystal shape of slide surface | Grain size (μm) | Content S of oriented Fe crystals (%) {110} | {200} | {211} | {310} | {222} | Hardness (HV) |
|---|---|---|---|---|---|---|---|---|
| 1 | AHP* | about 8 | 16.6 | 1.8 | 29.3 | 1.7 | 50.6 1 | 278 |
| 2 | Trigonal pyramid | about 10 | 32.8 | 1.2 | 20.8 | 2.2 | 43 | 302 |
| 3 | Trigonal pyramid<br>SP* | about 8<br>about 1 | 20 | 4 | 20 | 6 | 50 | 300 |
| 4 | Trigonal pyramid<br>SP* | about 8<br>about 1 | 20.7 | 3.3 | 30 | 5.4 | 40.6 | 400 |
| 5 | Trigonal pyramid<br>Plate-like | about 8 | 30 | 6 | 15 | 9 | 40 | 270 |
| 6 | Trigonal Pyramid<br>Plate-like | about 8 | 30 | 8 | 10 | 12 | 40 | 310 |
| 7 | Trigonal pyramid<br>SP* | about 6<br>about 1 | 20 | 12 | 30 | 18 | 20 | 410 |
| 8 | Trigonal pyramid<br>Very fine grain | about 8<br>≦0.5 | 10 | 15 | 15 | 20 | 40 | 310 |
| 9 | Trigonal pyramid<br>Very fine gain | about 8<br>≦0.5 | 12 | 23 | 15 | 10 | 40 | 280 |

AHP* = Approximately hexagonal pyramid
SP* = Small pyramid

TABLE 8

| Example No. | Crystal shape of slide surface | Grain size (μm) | Content S of oriented Fe crystals (%) {110} | {200} | {211} | {310} | {222} | Hardness (HV) |
|---|---|---|---|---|---|---|---|---|
| 10 | Very fine grain<br>Partially pyramid | about 0.5<br>about 5 | 15 | 27 | 15 | 13 | 30 | 290 |
| 11 | Very fine grain | <0.5 | 15 | 30 | 15 | 20 | 20 | 190 |
| 12 | Very fine grain | about 0.5 | 16 | 34 | 10 | 19 | 21 | 280 |
| 13 | SP*<br>Very fine grain | about 1<br>about 0.5 | 2 | 0 | 75 | 0 | 23 | 580 |
| 14 | Very fine grain | about 1 | 10 | 10 | 40 | 25 | 15 | 290 |
| 15 | Plate-like<br>Very fine grain | about 8<br>≦0.5 | 30 | 20 | 15 | 25 | 10 | 270 |
| 16 | Very fine grain | ≦0.5 | 20 | 20 | 15 | 25 | 20 | 320 |
| 17 | Very fine gain | ≦0.5 | 12 | 30 | 18 | 25 | 15 | 220 |

SP* = Small pyramid

Figure 7:
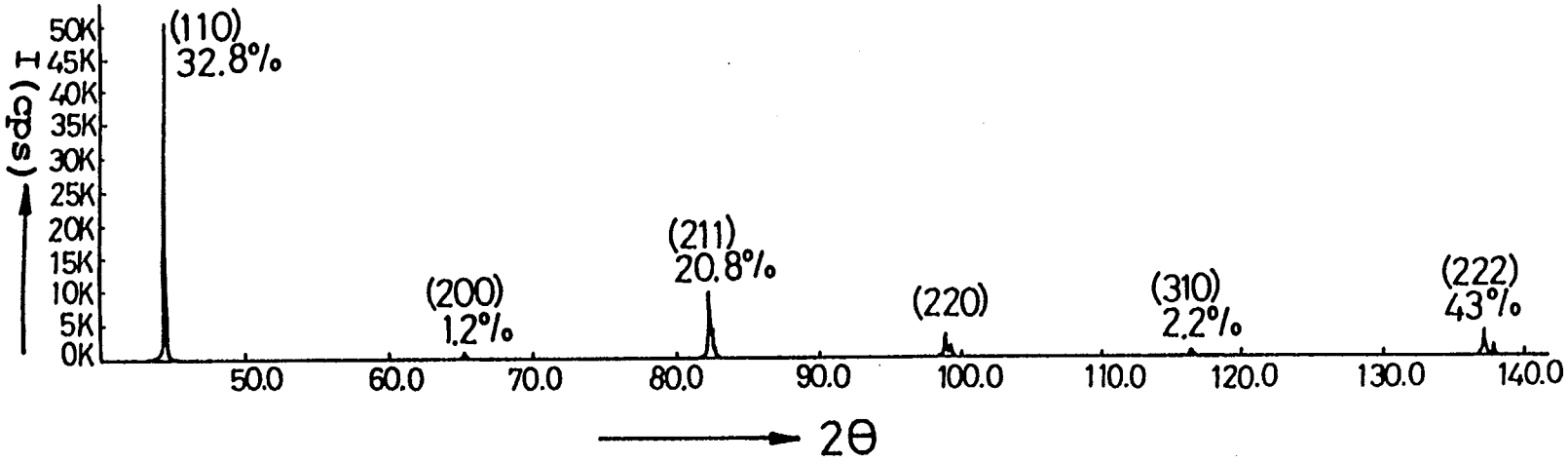
FIG. 7 is an X-ray diffraction pattern for a first example of the slide surface construction.

The content S was determined in the following manner on the basis of X-ray diffraction patterns (X-rays were applied in a direction perpendicular to the slide surface 4a) for the examples 1 to 17. Example 2 will be described below. FIG. 7 is an X-ray diffraction pattern for Example 2. The content S for each of the oriented Fe crystals was determined from each of following expressions. Here, the term "{110} oriented Fe crystal" means, for example, an oriented Fe crystal with its {110} plane oriented toward the slide surface 4a.

{110} oriented Fe crystals: $S_{110}=\{(I_{110}/IA_{110})/T\}\times 100$

{200} oriented Fe crystals: $S_{200}=\{(I_{200}/IA_{200})/T\}\times 100$

{211} oriented Fe crystals: $S_{211}=\{(I_{211}/IA_{211})/T\}\times 100$

{310} oriented Fe crystals: $S_{310}=\{(I_{310}/IA_{310})/T\}\times 100$

{222} oriented Fe crystals: $S_{222}=\{(I_{222}/IA_{222})/T\}\times 100$ wherein each of $I_{110}$, $I_{200}$, $I_{211}$, $I_{310}$ and $I_{222}$ is a measurement (cps) of the intensity of X-rays reflected from each crystal plane; each of $IA_{110}$, $IA_{200}$, $IA_{211}$, $IA_{310}$ and $IA_{222}$ is an intensity ratio of X-rays reflected from each crystal plane in an ASTM card. Further, $IA_{110}=100$, $IA_{200}=20$, $IA_{211}=30$, $IA_{310}=12$ and $IA_{222}=6$. Furthermore, $T=(I_{110}/IA_{110})+(I_{200}/IA_{200})+(I_{211}/IA_{211})+(I_{310}/IA_{310})+(I_{222}/IA_{222})$.

Figure 8:
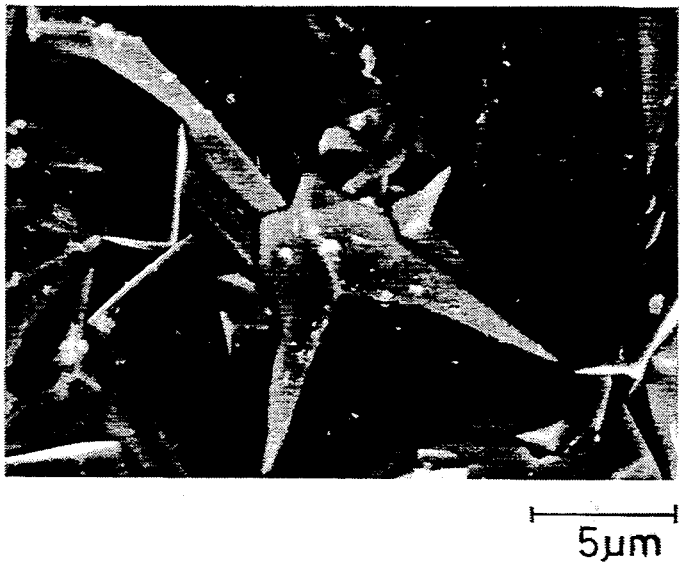
FIG. 8 is a photomicrograph showing the crystal structure of the slide surface in the first example of the slide surface construction.

FIG. 8 is a photomicrograph showing the crystal structure of the slide surface 4*a* in the example 2. In FIG. 8, a large number of mutually bitten trigonal pyramid-shaped Fe crystals are observed. As shown in Table 7 and FIF. 7, the content S of the (h00), i.e., {200} oriented Fe crystals in the example 2 is equal to 1.2%, and the content S of the (3hh0), i.e., {310} oriented Fe crystals in the example 2 is equal to 2.2%.

Figure 9:
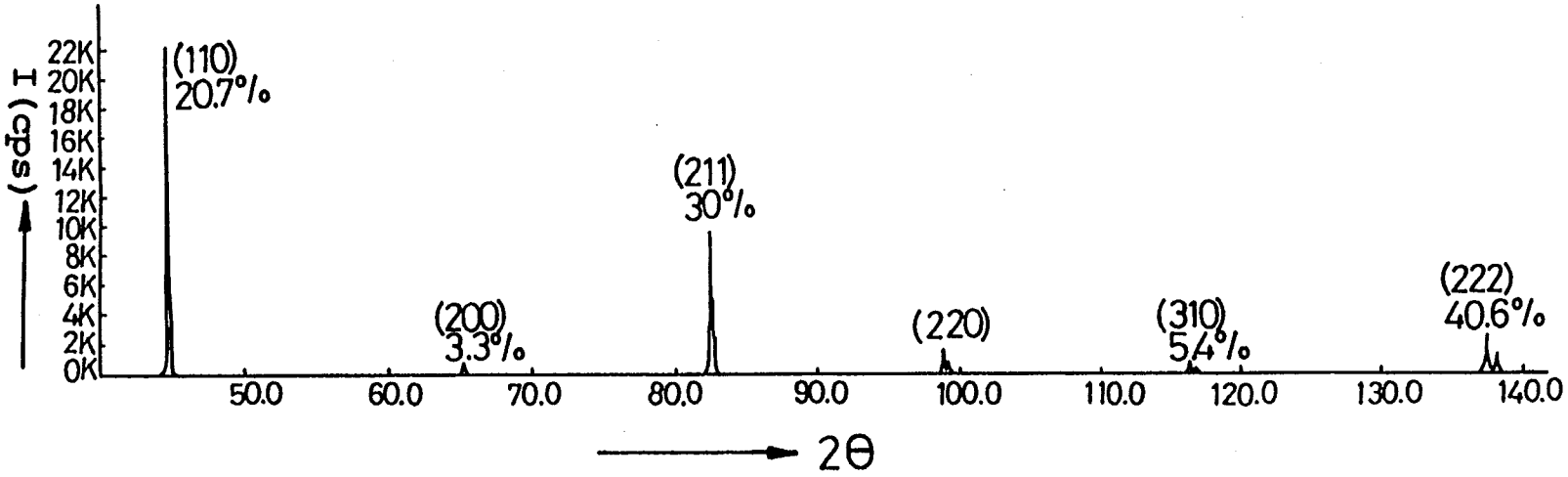
FIG. 9 is an X-ray diffraction pattern for a second example of the slide surface construction.
Figure 10:
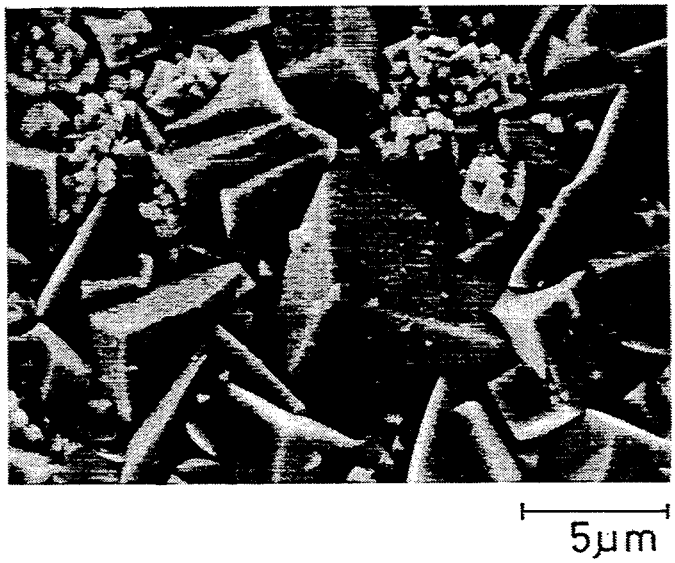
FIG. 10 is a photomicrograph showing the crystal structure of the slide surface in the second example of the slide surface construction.

FIG. 9 is an X-ray diffraction pattern of example 4, and FIG. 10 is a photomicrograph showing the crystal structure of the slide surface 4*a* in example 4. In FIG. 10, a large number of relatively large trigonal pyramid-shaped Fe crystals and a large number of small pyramid-shaped crystals are observed. It can be seen from FIG. 10 that oil swamps are formed between the trigonal pyramid-shaped Fe crystals, and oil swamps are formed even by the small pyramid-shaped Fe crystals precipitated in a very intricate state in the valleys thereof. As shown in Table 7 and FIG. 9, the content S of the {200} oriented Fe crystals in the example 4 is equal to 3.3%, and the content S of the (310) oriented Fe crystals in the example 4 is equal to 5.4%.

Figure 11:
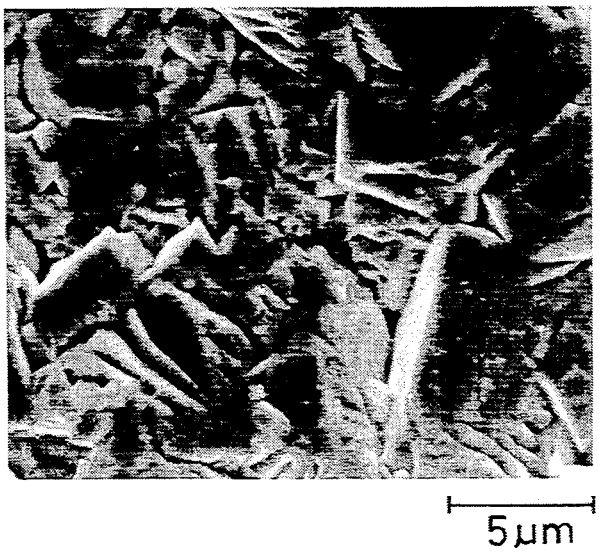
FIG. 11 is a photomicrograph showing the crystal structure of the slide surface in a third example of the slide surface construction.

FIG. 11 is a photomicrograph showing the crystal structure of the slide surface 4*a* in the example 17. It can be seen from FIG. 11 that if the content S of the {310} oriented Fe crystals in the example 4 is equal to or more than 25%, the slide surface 4*a* assumes a simplified morphology and is smoothed.

A seizure test for the examples 1 to 17 was carried out in a chip-on-disk manner to determine the seizure generating load, thereby providing the results shown in Tables 9 and 10. Conditions for the test were as follows: the material of the disk was an Al-10% by weight of Si alloy; the rotational speed of the disk was 15 m/sec.; the amount of oil supplied was 0.3 ml/min.; and the area of the slide surface of a chip made from the slide surface construction was 1 $cm^2$.

TABLE 9

| Example No. | Seizure generating load (N) |
|---|---|
| 1 | 860 |
| 2 | 850 |
| 3 | 810 |
| 4 | 800 |
| 5 | 810 |
| 6 | 800 |
| 7 | 700 |
| 8 | 650 |
| 9 | 600 |

TABLE 10

| Example No. | Seizure generating load (N) |
|---|---|
| 10 | 500 |
| 11 | 325 |
| 12 | 300 |
| 13 | 300 |

TABLE 10-continued

| Example No. | Seizure generating load (N) |
|---|---|
| 14 | 350 |
| 15 | 350 |
| 16 | 300 |
| 17 | 300 |

Figure 12:
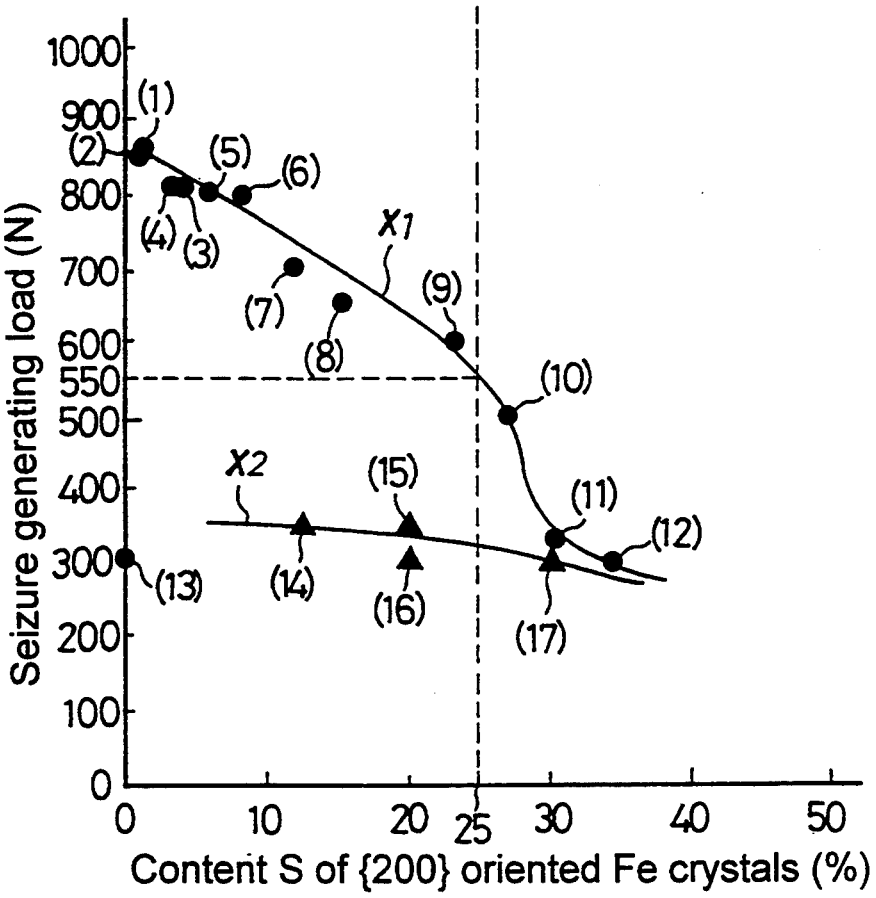
FIG. 12 is a graph illustrating the relationship between the content of {200} oriented Fe crystals and the seizure generating load.

FIG. 12 illustrates the relationship between the content S of the {200} oriented Fe crystals and the seizure generating load for the examples 1 to 17, wherein a line $x_1$ indicates the relationship when the content S of the {310} oriented Fe crystals is less than 25%, and a line $x_2$ indicates the relationship when the content S of the {310} oriented Fe crystals is equal to 25%. As apparent from FIG. 12 and the examples 1 to 9, the seizure generating load can be increased to 550 N or more to enhance the seizure resistance by setting the content S of the {200} oriented Fe crystals in a range represented by $S<25\%$ and setting the content S of the {310} oriented Fe crystals also in a range represented by $S<25\%$. However, if the contents S of the {200} and {310} oriented Fe crystals are equal to 0% as in the example 13, the seizure generating load is low.

Tables 11 and 12 shows the conditions for the electrolytic plating treatment used for examples 18 and 19 in which the content S of the {200} or {310} oriented Fe crystals was set at 0% in each of the slide surface constructions 4.

TABLE 11

| Example No. | Plating bath composition (g/liter) Ferrous sulfate | Boric Acid | Ammonium sulfate | Urea | Saccharin |
|---|---|---|---|---|---|
| 18 | 230 | 30 | 100 | 100 | 1 |
| 19 | 230 | 30 | 100 | 100 | 1 |

TABLE 12

| Example No. | Treating conditions Plating bath pH | Plating bath temperature (°C.) | Cathode Current density ($A/dm^2$) |
|---|---|---|---|
| 18 | 6.2 | 50 | 1.3 |
| 19 | 6 | 50 | 1.5 |

Table 13 shows the crystal shape of the slide surface 4*a*, the grain size of the $Fe_3$ crystals, the content S of the oriented Fe crystals and the hardness for the example 18 and 19.

TABLE 13

| Example No. | Crystal shape of slide surface | Grain size (μm) | Content S of oriented Fe crystals (%) {110} | {200} | {211} | {310} | {222} | Hardness (HV) |
|---|---|---|---|---|---|---|---|---|
| 18 | AHP* | about 8 | 10 | 3 | 17 | 0 | 70 | 305 |
| 19 | AHP | about 10 | 12 | 0 | 15 | 3 | 70 | 310 |

AHP* = Approximately hexagonal pyramid

A seizure test for the examples 18 and 19 was carried out in a chip-on-disk manner under the same conditions as those described above. As a result, it was confirmed that the examples 18 and 19 had a seizure generating load of 940 N. Thus, if either the {200} oriented Fe crystals or the {310} oriented Fe crystals is present, the slide surface construction 4 has an excellent seizure resistance. In this case, when the content S of the {200} oriented Fe crystals is equal to 0%, the content S of the {310} oriented Fe crystals is less than 25%. On the other hand, when the content S of the {310} oriented Fe crystals is equal to 0%, the content S of the {200} oriented Fe crystals is less than 25%.

In the metal crystals having the body-centered cubic structure, the crystal shape produced on the slide surface, crystal planes located on the slants (which include the opposite triangular end faces in FIG. 16) and the like for the oriented metal crystals are shown in Table 14.

TABLE 14

Figure 13:
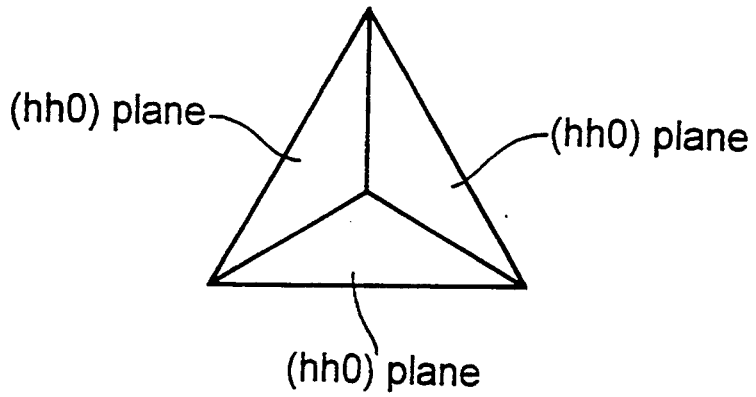
FIG. 13 is a plane view illustrating crystal planes located on slants at a trigonal pyramid-shaped tip end portion.
Figure 14:
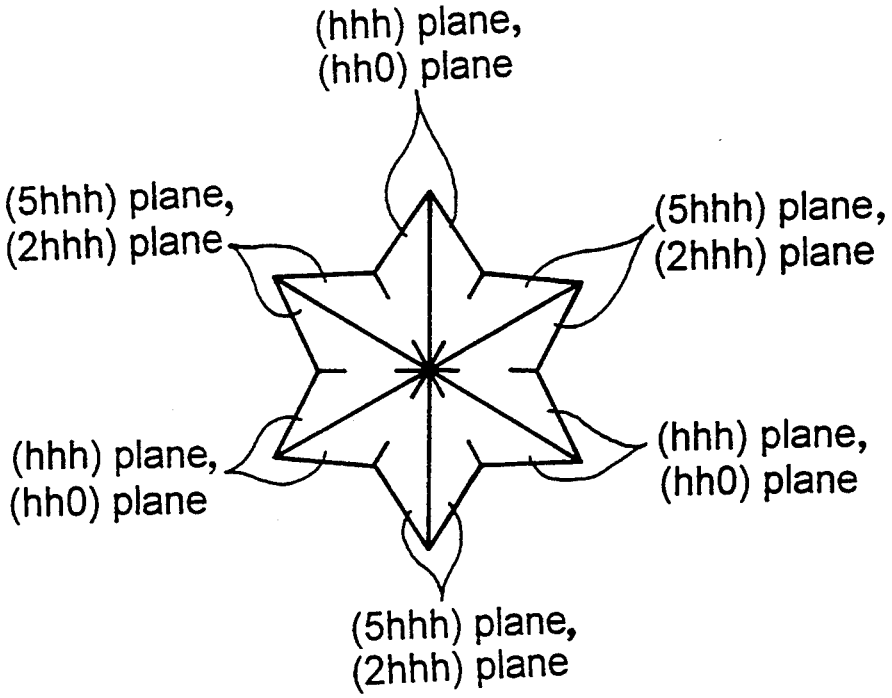
FIG. 14 is a plan view illustrating crystal planes located on slants in one example of a hexagonal pyramid-shaped tip end portion.
Figure 15:
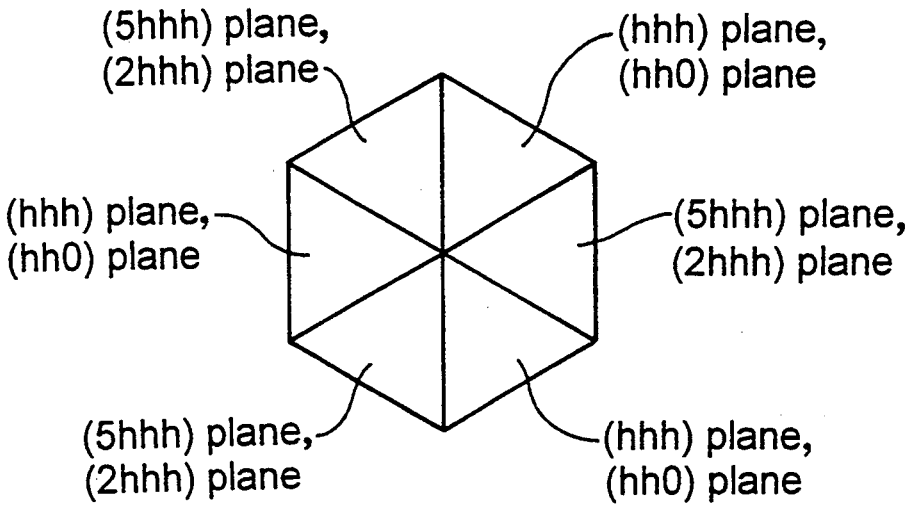
FIG. 15 is a plan view illustrating crystal planes located on slants in another example of a hexagonal pyramid-shaped tip end portion.
Figure 16:
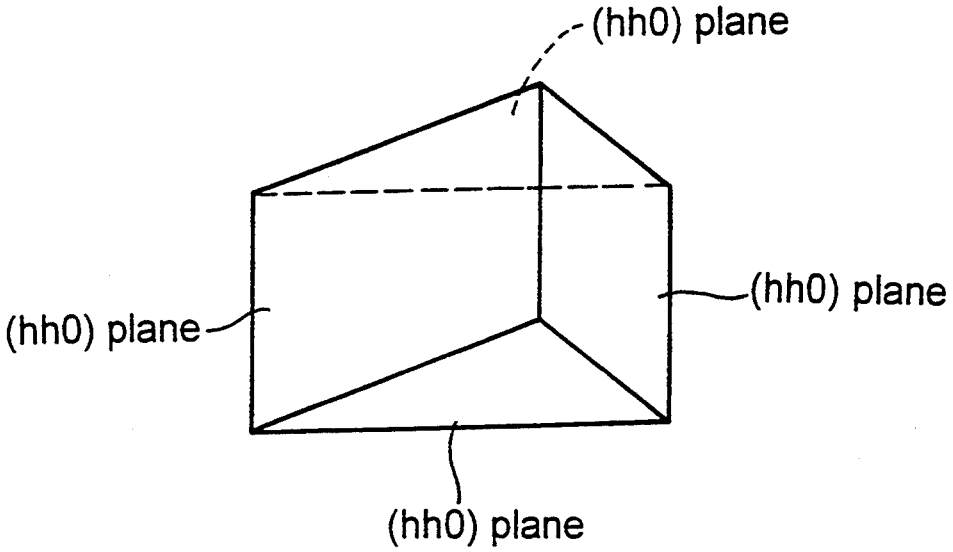
FIG. 16 is a perspective view illustrating crystal planes located on slants and end faces of a small pyramid-shaped tip end portion.
Figure 17:
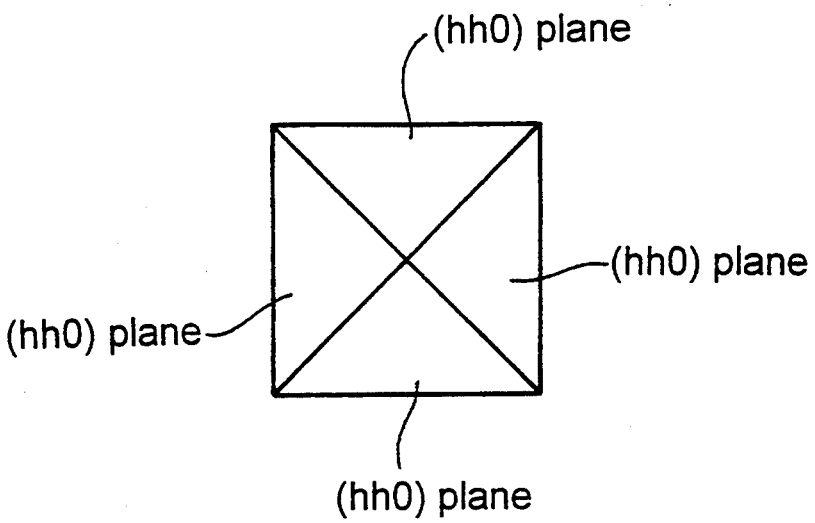
FIG. 17 is a plane view illustrating the crystal planes located on slants of a quadrangular pyramid-shaped tip end portion.

| Oriented metal crystal | Crystal shape on slide surface | Crystal plane located on slant | Characteristic slant | Referential drawing |
|---|---|---|---|---|
| (hhh) | Trigonal pyramid | (hh0) plane: close-packed plane | High hardness, good wettability and good wear resistance | FIG. 13 |
| | Hexagonal pyramid | (hhh) plane: 50%, 5(hhh) plane: 50% | Excellent wettability because of (hhh) plane having a large surface energy | FIG. 14: concave slant FIG. 15: flat slant |
| | | (hh0) plane: 50% (2hhh) plane: 50% (hh0) plane: close-packed plane | High hardness, good wettabilty and good wear resistance | |
| (2hhh) | Small pyramid | (hh0) plane: close-packed plane | High hardness good wettability and good wear resistance | FIG. 16 |
| (h00) | Quadrangular pyramid | (hh0) plane: close-packed plane | High hardness good wettability and good wear resistance | FIG. 17 |

It should be noted that for the wettability of the crystal planes located on the slants to oil or the like, the (hhh) plane is superior on the (hh0) plane.

The slide surface construction according to the present invention is applicable, for example, to the slide portion of any of following parts of an internal combustion engine: pistons (ring grooves), piston rings, piston pins, connecting rods, crankshafts, bearing metals, oil pump rotors, oil pump rotor housings, cam shafts, springs (end faces), spring seats, spring retainers, cotters, rocker arms, roller bearing outer cases, roller bearing inner cases, valve stems, valve faces, hydraulic tappets, water pump rotor shafts, pulleys, gears, transmission shaft portions, clutch plates, washers, and bolts (bearing surfaces and threaded portions).

What is claimed is:

1. A slide surface construction, which is formed of an aggregate of Fe crystals having a body-centered cubic structure, the aggregate including at least one of two types of Fe crystals selected from the group consisting of (1) (h00) oriented Fe crystals with their (h00) planes (by Miller indices) oriented toward the slide surface and having a content S in a range represented by $S<25\%$, and (2) (3hh0) oriented Fe crystals with their (3hh0) planes (by Miller indices) oriented toward the slide surface and having a content S in a range represented by $S<25\%$.

2. A slide surface construction, which is formed of an aggregate of Fe crystals having a body-centered cubic structure, wherein the content S of (h00) oriented Fe crystals in the aggregate with their (h00) planes (by Miller indices) oriented toward the slide surface being equal to 0%, and the content S of (3hh0) oriented metal crystals in the aggregate with their (3hh0) planes (by Miller indices) oriented toward the slide surface being in a range represented by $S<25\%$.

3. A slide surface construction, which is formed of an aggregate of Fe crystals having a body-centered cubic structure, wherein the content S of (h00) oriented Fe crystals in the aggregate with their (h00) planes (by Miller indices) oriented toward a slide surface being in a range represented by $S<25\%$, and the content S of (3hh0) oriented Fe crystals in the aggregate with their (3hh0) planes (by Miller indices) oriented toward the slide surface being equal to 0%.

4. A slide surface construction according to claim 1, 2 or 3, wherein said (h00) plane corresponds to a {200} plane; and (3hh0) plane corresponds to a {310} plane; and at least one of a large number of pyramid-shaped Fe crystals and a large number of truncated pyramid-shaped Fe crystals are precipitated in said slide surface due to the presence of at least one of {200} and {310} oriented Fe crystals.

5. A slide surface construction according to claim 1, wherein the inclination angle $\theta$ of said (h00) plane and said (3hh0) plane is set in a range of $0° \leqq \theta \leqq 15°$.

6. A slide surface construction according to claim 2, wherein the inclination angle $\theta$ of said (3hh0) plane is set in a range of $0° \leqq \theta \leqq 15°$.

7. A slide surface construction according to claim 3, wherein the inclination angle $\theta$ of said (h00) plane is set in a range of $0° \leqq \theta \leqq 15°$.

* * * * *